US005438801A

United States Patent [19]

Ishihara et al.

[11] Patent Number: 5,438,801

[45] Date of Patent: Aug. 8, 1995

[54] QUARTER WINDOW OPENING/CLOSING APPARATUS

[75] Inventors: Mikiya Ishihara; Takahiro Yamada; Fumihiro Shimizu, all of Shizuoka, Japan

[73] Assignee: Asmo Co., Ltd., Shizuoka, Japan

[21] Appl. No.: 258,058

[22] Filed: Jun. 10, 1994

[30] Foreign Application Priority Data

Jul. 1, 1993 [JP] Japan ..... 5-036240 U

[51] Int. Cl.[6] ..... E05F 11/00

[52] U.S. Cl. ..... 49/357; 49/324; 292/263

[58] Field of Search ..... 49/324, 394, 357, 334; 292/263, DIG. 73, DIG. 6; 16/DIG. 6

[56] References Cited

U.S. PATENT DOCUMENTS 2,720,673 10/1955 Wise ..... 292/263 X
3,093,258 6/1963 Turner ..... 292/263 X
3,351,369 11/1967 Hogstrom ..... 292/263
4,249,771 2/1981 Gergoe et al. ..... 292/263 X
4,918,865 4/1990 Hirai ..... 49/357 X
5,161,419 11/1992 Moy et al. .
5,203,113 4/1993 Yagi ..... 49/357 X

*Primary Examiner*—Jerry Redman
*Attorney, Agent, or Firm*—Fisher & Associates

[57] ABSTRACT

A quarter window opening/closing apparatus in which a torsion coil spring is provided at a link-connecting portion where a second link is rotatably connected to a first link is provided. When the quarter window is in a state other than a fully closed or fully open state, the torsion coil spring urges the quarter window in its opening direction by means of the second link. Accordingly, the occurrence of rattling of the quarter window is prevented even when the quarter window is in a state other than fully closed or fully open.

16 Claims, 13 Drawing Sheets

QUARTER WINDOW OPENING/CLOSING APPARATUS

BACKGROUND OF THE INVENTION

1. Field of the Invention

The present invention relates to a quarter window opening/closing apparatus for opening and closing a quarter window of a vehicle by using a link mechanism.

2. Description of the Related Art

Some one-box cars and two-door sedans are provided with quarter window opening/closing apparatus of a tilting-type. This quarter window opening/closing apparatus of a tilting type comprises a first link having one end attached rotatably to the vehicle body and a second link which has one end connected rotatably to another end of the first link and has another end connected rotatably to the quarter window by means of a bracket. As the first link is rotated about its one end, the second link is rotated forcibly, so as to open or close the quarter window.

In this tilting-type quarter window opening/closing apparatus, since there are clearances between respective members in an assembled state, the apparatus needs to be arranged so as not to cause the quarter window to rattle due to wind pressure, vibration of the vehicle body or the like which occur during the running of the vehicle. The prevention of the rattling of the quarter window will be described below by citing a structure disclosed in U.S. Pat. No. 4,918,865.

FIGS. 11 to 13 show a link mechanism 100 of a tilting-type quarter window opening/closing apparatus disclosed in that patent specification. FIG. 11 is a vertical cross-sectional view of a quarter window 102 in a fully closed state, while FIG. 12 is a vertical cross-sectional view of the quarter window 102 in a fully open state.

One end of a first link 104 is attached to a rotating shaft 106, and the first link 104 is adapted to rotate about the rotating shaft 106 by a driving force of an unillustrated motor. Connected to the other end of the first link 104 is one end of a second link 108 by means of a pin 110 in such a manner as to be capable of undergoing relative rotation. In addition, the other end of the second link 108 is rotatably connected to a bracket 112, which is fixed to the quarter window 102, by means of a ball joint 114. Accordingly, when the link 104 is rotated about the rotating shaft 106 by receiving the driving force of the motor, the quarter window 102 is set in a fully closed state, as shown in FIG. 11, from a fully open state, or in a fully open state, as shown in FIG. 12, from a fully closed state.

In addition, this tilting-type quarter window opening/closing apparatus is provided with a lock mechanism which will be described below, so as to prevent the quarter window 102 from opening (or closing) due to an unexpected external force when the quarter window 102 is in a fully closed state (or a fully open state).

Namely, in the fully closed state, the pin 110 is located on a lower side, as viewed in FIG. 11, of a straight line Y connecting the rotating shaft 106 and the ball joint 114, and a portion of a peripheral surface of a boss of the first link 104 abuts against a closed-state stopper portion 116 of the second link 108. Meanwhile, in the fully open state, the pin 110 is located on the lower side, as viewed in FIG. 12, of the straight line Y connecting the rotating shaft 106 and the ball joint 114, and a side surface of the first link 104 abuts against an open-state stopper portion 118 of the second link 108. Consequently, the quarter window 102 in the fully closed state is prevented from being opened by an unexpected external force, and the quarter window 102 in the fully open state is prevented from being closed by an unexpected external force. Also, this lock mechanism demonstrates the effect of preventing the rattling of the quarter window 102 in the fully closed or fully open state. In other words, the lock mechanism also serves as a rattling-preventing mechanism.

However, although, in the case of the structure disclosed in this publication, the effect of preventing the rattling of the quarter window 102 is obtained in the fully closed or fully open state by the lock mechanism, the action of the closed-state stopper portion 116 and the open-state stopper portion 118 is not demonstrated when the quarter window is set in a state other than the fully open or fully closed state (e.g., a semi-open state), as shown in FIG. 13. Thus, when the quarter window 102 is set in the semi-open state, the first link 104 and the second link 108 are rotatable about the rotating shaft 106 and the pin 110, respectively, as indicated by the arrows in the drawing, and rattling can occur in the quarter window 102, producing abnormal noise.

SUMMARY OF THE INVENTION

In view of the above-described problems, it is an object of the present invention to provide a quarter window opening/closing apparatus which is capable of preventing the rattling of the quarter window when the quarter window is set in a state other than a fully open or fully closed state.

In accordance with one aspect of the present invention, there is provided a quarter window opening/closing apparatus comprising: a quarter window; a first link having one end attached rotatably to a vehicle body; a second link having one end connected rotatably to another end of the first link and another end attached rotatably to the quarter window; and urging means provided on a link-connecting portion where one end of the second link is connected rotatably to the other end of the first link, the urging means being adapted to urge the quarter window in one of an opening direction and a closing direction by means of the second link when the quarter window is in a state other than a fully closed state and a fully open state.

In accordance with this aspect of the present invention, to set the quarter window in the fully open or fully closed state, it suffices to rotate the first link about its one end. As a result, the second link undergoes relative rotation about the other end of the first link, thereby setting the quarter window of the vehicle in the fully open or fully closed state.

Here, in a case where the quarter window is set in a state (e.g., a semi-open state) other the fully open or fully closed state, the urging force of the urging means acting in the opening or closing direction of the quarter window acts on the quarter window by means of the second link. For this reason, even if the quarter window is set in a state other than the fully open or fully closed state, it is possible to eliminate the rattling of the quarter window which is caused by clearances formed between members during assembly, so that the occurrence of abnormal noise can be prevented.

The above and other objects, features and advantages of the present invention will become more apparent from the following detailed description of the invention when read in conjunction with the accompanying drawings.

DESCRIPTION OF THE PREFERRED EMBODIMENTS

Figure 1:
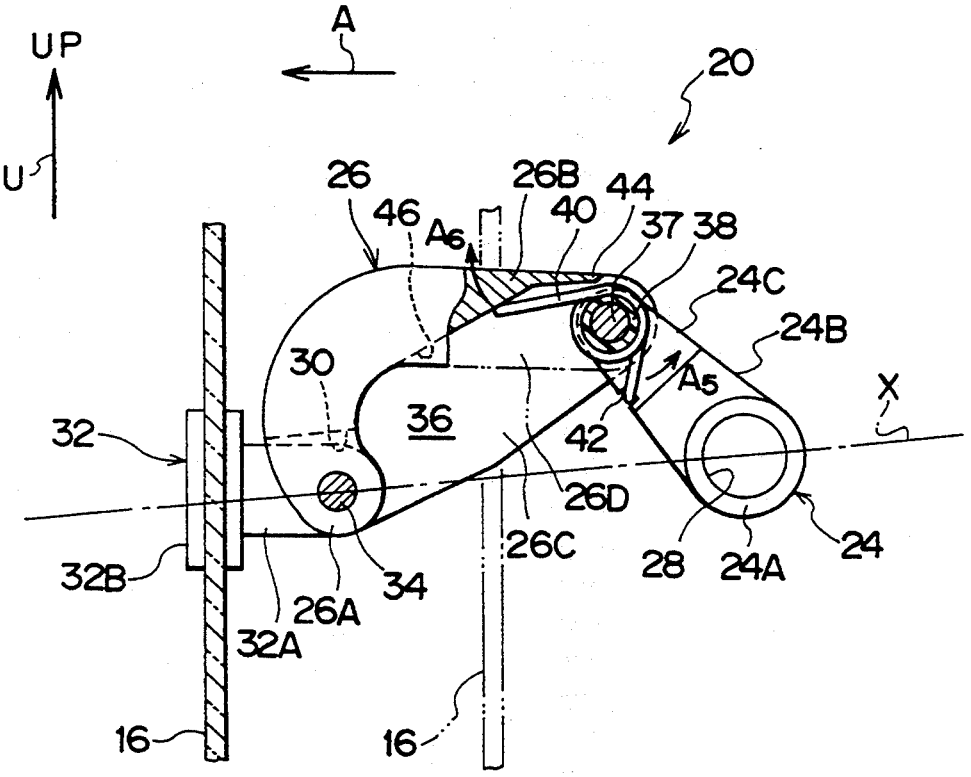
FIG. 1 is an operational diagram of essential portions of a quarter window opening/closing apparatus in accordance with an embodiment, and illustrates a state of a link mechanism when the quarter window is set in a semi-open state.

Referring now to FIGS. 1 to 5, a description will be given of a quarter window opening/closing apparatus 10 in accordance with an embodiment of the present invention. It should be noted that the arrow F shown in FIG. 5 indicates a forward direction of the vehicle, while the arrow U shown in the drawings indicates an upper direction of the vehicle.

Figure 5:
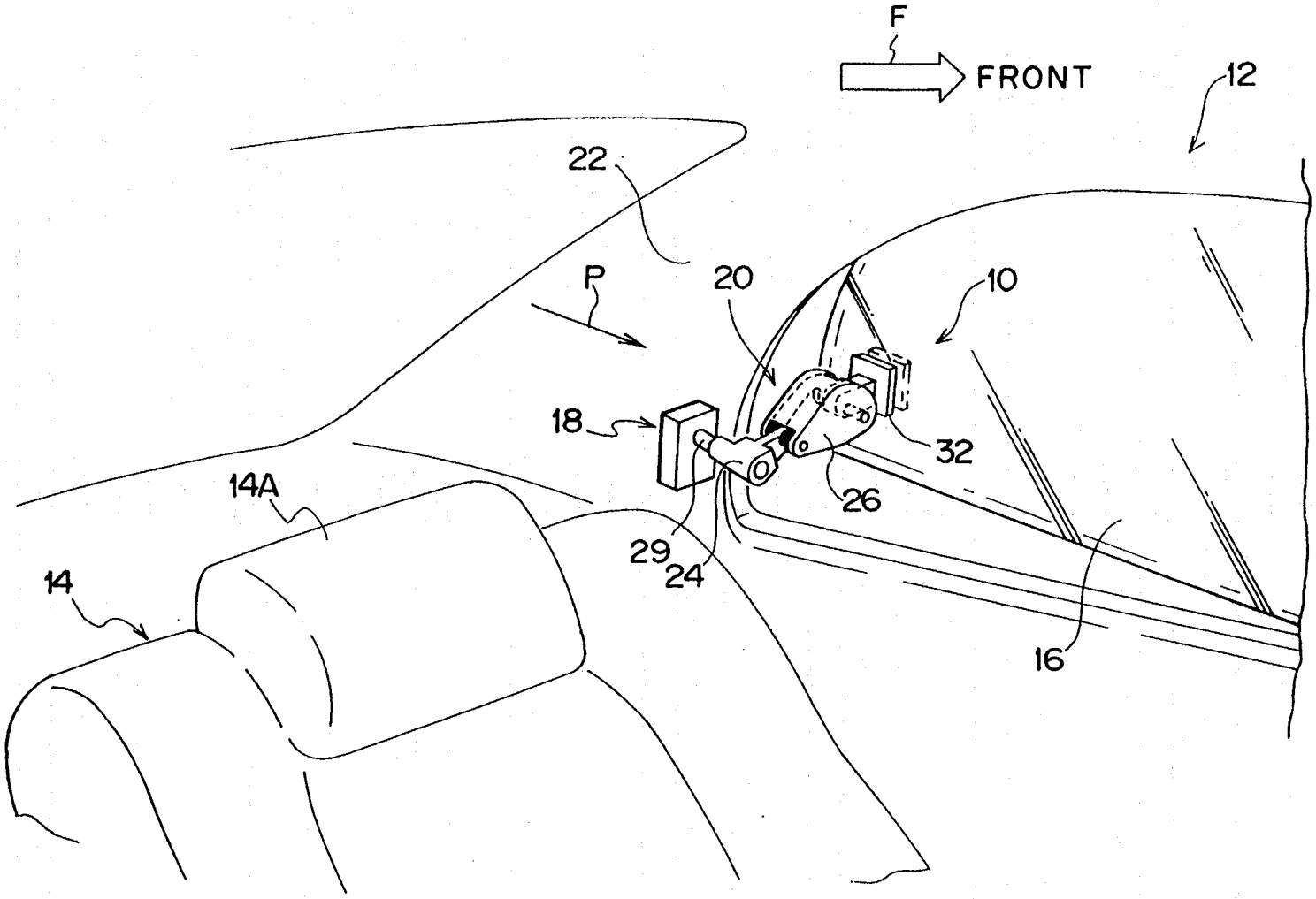
FIG. 5 is a perspective view illustrating the appearance of the quarter window opening-closing apparatus fitted in a vehicle compartment.

FIG. 5 is a perspective view, taken from the vehicle compartment side, of the quarter window opening-closing apparatus 10 located in the vicinity of a rear seat 14 of a two-door sedan 12. A front end (as viewed in the forward direction of the vehicle) of a quarter window 16 is rotatably supported. The quarter window opening/closing apparatus 10 is disposed so as to open and close the quarter window 16 by rotating the quarter window 16 about its front end.

The quarter window opening/closing apparatus 10 is generally comprised of a driving unit 18 and a link mechanism 20. The driving unit 18 is disposed at a predetermined position on a quarter pillar 22 on the vehicle compartment side (i.e., in the vicinity of a headrest 14A of the rear seat 14). The driving unit 18 is provided with a motor, which is rotated forwardly or reversely by opening an unillustrated operating switch, as well as a connecting means including a pinion and a reducing gear.

Figure 2:
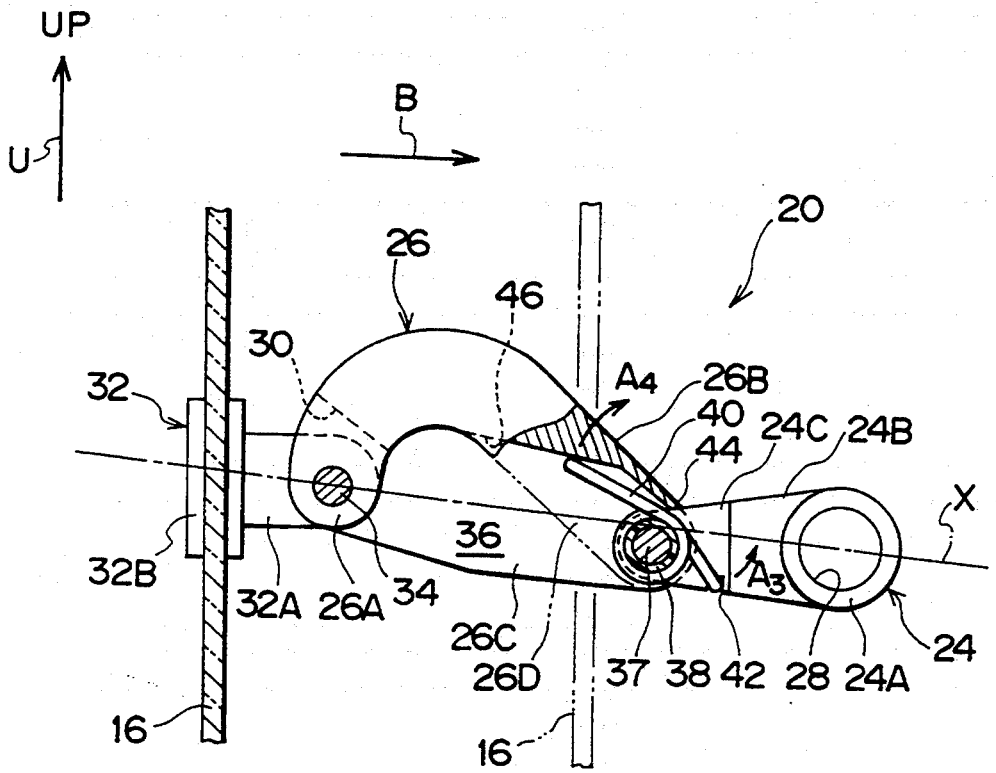
FIG. 2 is an operational diagram illustrating a state of the ink mechanism when the quarter window is set in a fully open state.
Figure 3:
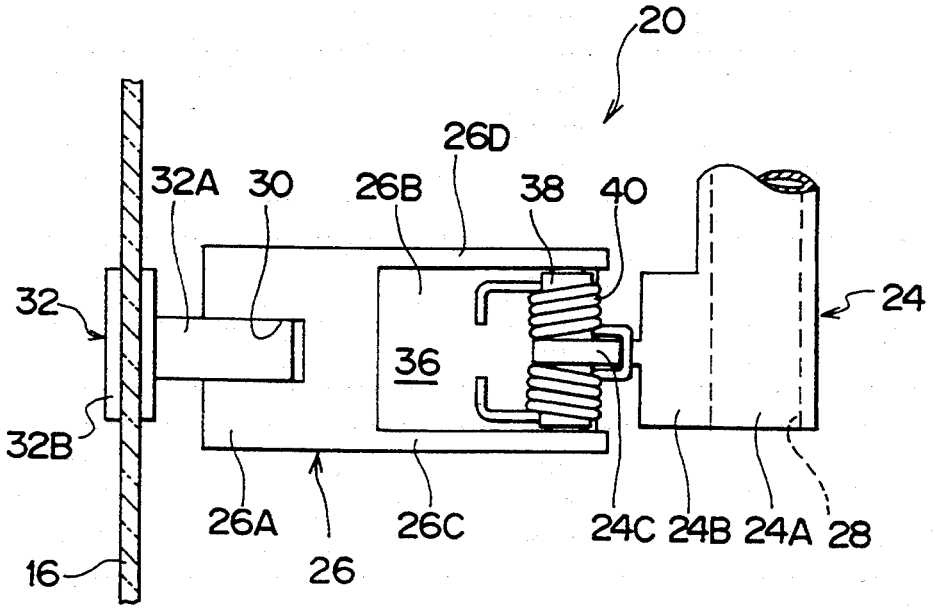
FIG. 3 is a bottom view of the link mechanism shown in FIG. 2.
Figure 4:
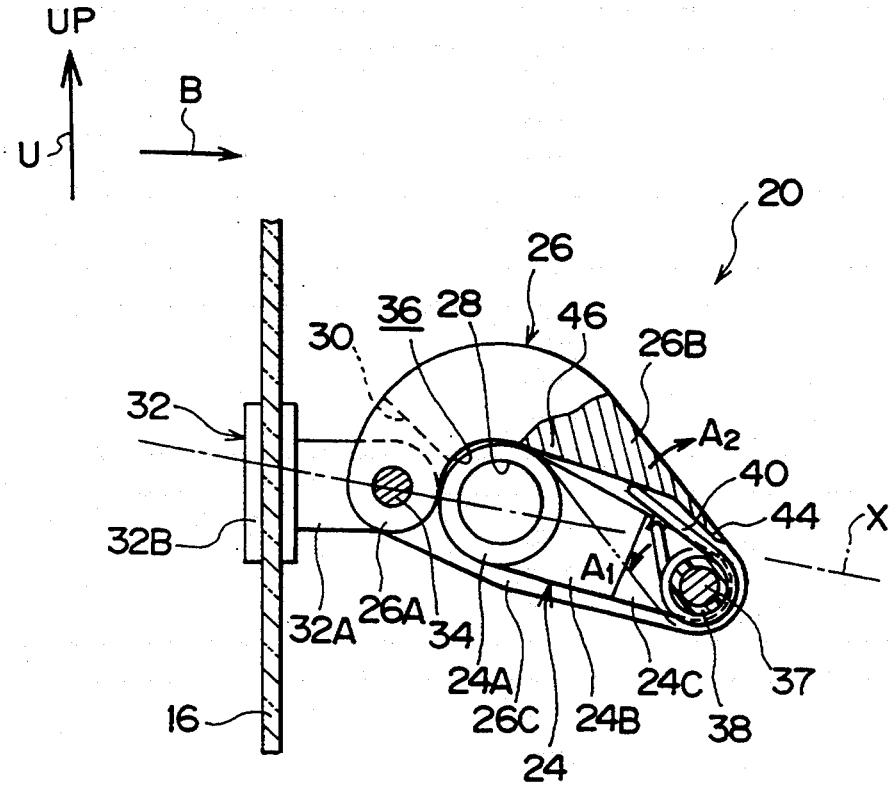
FIG. 4 is an operational diagram illustrating a state of the link mechanism when the quarter window is set in a fully closed state.

FIGS. 1 to 4 show the link mechanism 20 in various states corresponding to the degree of opening of the quarter window 16. Incidentally, FIG. 4 shows a perspective view (taken in the direction of arrow P in FIG. 5) of the state of the link mechanism 20 when the quarter window 16 is set in the fully closed state. FIGS. 2 and 3 show a side elevational view and a bottom view of the state of the link mechanism 20 when the quarter window 16 is set in the fully open state. Further, FIG. 1 shows a side elevational view of the state of the link mechanism 20 when the quarter window 16 is set in a semi-open state. Hereafter, a detailed description will be given of the arrangement of the link mechanism 20 by mainly referring to FIGS. 2 and 3.

The link mechanism 20 comprises a first link 24 and a second link 26. The first link 24 includes a hollow cylindrical boss 24A, a projection 24B projecting from the boss 24A in a radial direction thereof, and a thin connecting portion 24C further projecting in the same radial direction from an intermediate portion (as viewed in the thicknesswise direction of the projection 24B, i.e., along the axial direction of the boss 24A) of the projection 24B. Serrations are formed on an inner peripheral surface of a through hole 28 provided in an axial portion of the boss 24A. A spline shaft 29 (see FIG. 5), which is connected to an output shaft of the motor by means of the connecting means, is fitted in this through hole 28.

Meanwhile, the second link 26 includes a substantially hollow cylindrical boss 26A, an apex wall portion 26B extending from a peripheral surface of the boss 26A in a radial direction thereof, and a pair of side wall portions 26C and 26D which are formed in parallel with each other in such a manner as to extend from both ends of the boss 26A in the radial direction thereof and downward from both ends of the apex wall portion 26B. A slit-like recess 30 is formed in an axially intermediate portion of the boss 26A, and a flange 32A of a bracket 32 is inserted in this recess 30. The boss 26A of the second link 26 and the flange 32A of the bracket 32 are connected to each other by means of a connecting pin 34 in such a manner as to be capable of undergoing relative rotation. The bracket 32 has a base plate 32B whose widthwise direction is arranged orthogonally to the thicknesswise direction of the flange 32A (i.e., to the axial direction of the boss 26A). This base plate 32B is affixed to the quarter window 16.

The apex wall portion 26B of the second link 26 is formed in a convex shape protruding in the upward direction of the vehicle. As a result, a predetermined recess 36 is formed by the apex wall portion 26B and the pair of side wall portions 26C, 26D. The first link 24 is accommodated in this recess 36 when the quarter window 16 is set in the fully closed state (see FIG. 4). In addition, a connecting pin 37 is inserted in and extends between the pair of side wall portions 26C and 26D, and a hollow cylindrical collar 38 is fitted over an outer periphery of this connecting pin 37. The aforementioned connecting portion 24C of the first link 24 is inserted over an axially intermediate portion of this collar 38 in such a manner as to be capable of undergoing relative rotation. Consequently, the first link 24 and the second link 26 are connected together.

In addition, a torsion coil spring 40 is fitted over the collar 38 in such a manner as to sandwich the connecting portion 24C of the first link 24. In other words, the thickness of the connecting portion 24C of the first link 24 is made thinner than the thickness of the projection 24B so as to provide spaces on both sides of the connecting portion 24C for accommodating the torsion coil spring 40 and disposing the coil spring 40 over the collar 38 on both sides thereof. End portions of the torsion coil spring 40 are bent in mutually approaching directions, and are both brought into contact with and retained at a lower surface of the apex wall portion 26B of the second link 26. An intermediate portion of the torsion coil spring 40 is bent substantially in a U-shape (see FIG. 3), and is retained at a notch 42 formed in the vicinity of a junction between the connecting portion 24C and the projection 24B of the first link 24. Incidentally, an urging force of this torsion coil spring 40 will be described in detail in connection with the operation of the embodiment.

As shown in FIG. 2, when the quarter window 16 is in the fully open state, the connecting pin 37 connecting the first link 24 and the second link 26 is located on the lower side, as viewed in the vertical direction of the vehicle, with respect to a straight line X connecting the center of the boss 24A of the first link 24 and the center of the boss 26A of the second link 26. Further, in this state, an upper end surface of the connecting portion 24C of the first link 24 abuts against a distal end (hereafter referred to as an open-state stopper 44) of the apex wall portion 26B of the second link 26. Accordingly, the first link 24 cannot further rotate counterclockwise by overriding the position shown in FIG. 2.

Meanwhile, when the quarter window 16 is in the fully closed state, as shown in FIG. 4, the connecting pin 37 is located on the lower side, as viewed in the vertical direction of the vehicle, with respect to the straight line X. This is the same as in the case of the fully open state. Further, in this state, a portion of the peripheral surface of the boss 24A of the first link 24 abuts against a predetermined portion (hereafter referred to as a closed-state stopper 46) of the lower surface of the apex wall portion 26B of the second link 26. Accordingly, the first link 24 cannot further rotate in the clockwise by overriding the position shown in FIG. 4.

Hereafter, a description will be given of the operation of this embodiment.

As shown in FIG. 4, when the quarter window 16 is set in the fully closed state, the first link 24 remains accommodated in the recess 36 provided in the second link 26. At this time, the connecting pin 37 connecting the first and second links 24 and 26 is located on the lower side, as viewed in the vertical direction of the vehicle, with respect to the straight line X, and the portion of the peripheral surface of the boss 24A of the first link 24 abuts against the closed-state stopper 46 at the apex wall portion 26B of the second link 26. Hence, the first link 24 cannot rotate clockwise further from the position illustrated in FIG. 4. Accordingly, even if an occupant of the vehicle inadvertently presses the quarter window 16 in the opening direction, the quarter window 16 is not set in the open state. In addition, even if the quarter window 16 is subjected to an external force in the opening direction by wind pressure, vibration of the vehicle body or the like during the running of the vehicle, the quarter window 16 is prevented from rattling.

In this fully closed state, the urging force (resiliently restoring force) accumulated in the torsion coil spring 40 is maximum. Incidentally, the intermediate portion of the torsion coil spring 40 presses the first link 24 in the direction of arrow $A_1$ in FIG. 4, while both ends of the torsion coil spring 40 press the second link 26 in the direction of arrow $A_2$ in FIG. 4. Accordingly, when the entire system of the link mechanism 20 is considered, the torsion coil spring 40 urges the quarter window 16 in the closing direction (i.e., in the direction of arrow B in FIG. 4) by means of the second link 26. For this reason, the urging force of the torsion coil spring 40 (i.e., the urging force acting in the direction in which the quarter window 16 is closed) makes the prevention of rattling in this state more reliable.

To set the quarter window 16 in the fully open state from this state, it suffices to press an unillustrated operating switch (on the open-position side). This causes the motor to rotate forwardly in correspondence with the time duration of the switch being pressed. By receiving this driving force, the first link 24 rotates counterclockwise about the boss 24A. Consequently, the second link 26 is pressed by the first link 24 and undergoes relative rotation about the connecting pin 37, thereby assuming the state shown in FIG. 2.

At this juncture, the connecting pin 37 connecting the first and second links 24 and 26 is located on the lower side of the straight line X, and the upper end surface of the connecting portion 24C of the first link 24 abuts against the open-state stopper 44 at the apex wall portion 26B of the second link 26. Hence, the first link 24 cannot rotate counterclockwise further from the position illustrated in FIG. 2. Accordingly, even if the occupant of the vehicle inadvertently pulls the quarter window 16 in the closing direction, the quarter window 16 is not set in the closed state. In addition, even if the quarter window 16 is subjected to an external force in the closing direction by wind pressure, vibration of the vehicle body or the like during the running of the vehicle, the quarter window 16 is prevented from rattling.

In this fully open state, the urging force (resiliently restoring force) accumulated in the torsion coil spring 40 is minimum. Incidentally, the intermediate portion of the torsion coil spring 40 presses the first link 24 in the direction of arrow $A_3$ in FIG. 2, while both ends of the torsion coil spring 40 press the second link 26 in the direction of arrow $A_4$ in FIG. 2. Accordingly, when the entire system of the link mechanism 20 is considered, the torsion coil spring 40 urges the quarter window 16 in the closing direction (i.e., in the direction of arrow B in FIG. 2) by means of the second link 26. Namely, this is similar to the above-described case of the fully closed state. For this reason, the urging force of the torsion coil spring 40 (i.e., the urging force acting in the direction in which the quarter window 16 is closed) makes the prevention of rattling in this state more reliable.

Here, to set the quarter window 16 in a semi-open state from the fully closed state, as shown in FIG. 1, it suffices if the time duration of the operating switch (on the open-position side) being pressed is made shorter than that for the fully opening operation. This causes the first and second links 24 and 26 to rotate, respectively, in the same way as in the fully opening operation, and the state shown in FIG. 1 is obtained.

In this semi-open state, since the upper end surface of the connecting portion 24C of the first link 24 does not abut against the open-state stopper 44 at the apex wall portion 26B of the second link 26, the quarter window 16 in the conventional case would be in an unstable state. In this embodiment, however, the urging force of the torsion coil spring 40 (i.e., an intermediate urging force between the aforementioned maximum and minimum forces) acts even in this state. More specifically, in this semi-open state, the connecting pin 37 connecting the first and second links 24 and 26 is located on the upper side, as viewed in the vertical direction of the vehicle, with respect to the straight line X. At the same time, the intermediate portion of the torsion coil spring 40 presses the first link 24 in the direction of arrow $A_5$ in FIG. 1, while both ends of the torsion coil spring 40 press the second link 26 in the direction of arrow $A_6$ in FIG. 1. Accordingly, when the entire system of the link mechanism 20 is considered, the torsion coil spring 40 urges the quarter window 16 in the opening direction (i.e., in the direction of arrow A in FIG. 1) by means of the second link 26. In other words, the urging direction of the torsion coil spring 40 with respect to the entire system of the link mechanism 20 is inverted from that for the fully open state shown in FIG. 2 and the fully closed state shown in FIG. 4. Hence, the quarter window 16 is pressed in the opening direction by means of the second link 26. Accordingly, the quarter window 16 maintains a stable state, and rattling caused by wind pressure, vibration of the vehicle body or the like is prevented.

Thus, in accordance with this embodiment, the torsion coil spring 40 having an urging force in the direction of opening the quarter window 16 in the semi-open state of the quarter window 16 is provided at the connecting portion between the first and second links 24 and 26 for opening and closing the quarter window 16. Accordingly, even if the quarter window 16 is set in the semi-open state, it is possible to effectively prevent the rattling of the quarter window 16 due to .the wind pressure, vibration of the vehicle body, or the like, thereby preventing the occurrence of abnormal noise.

Figure 6:
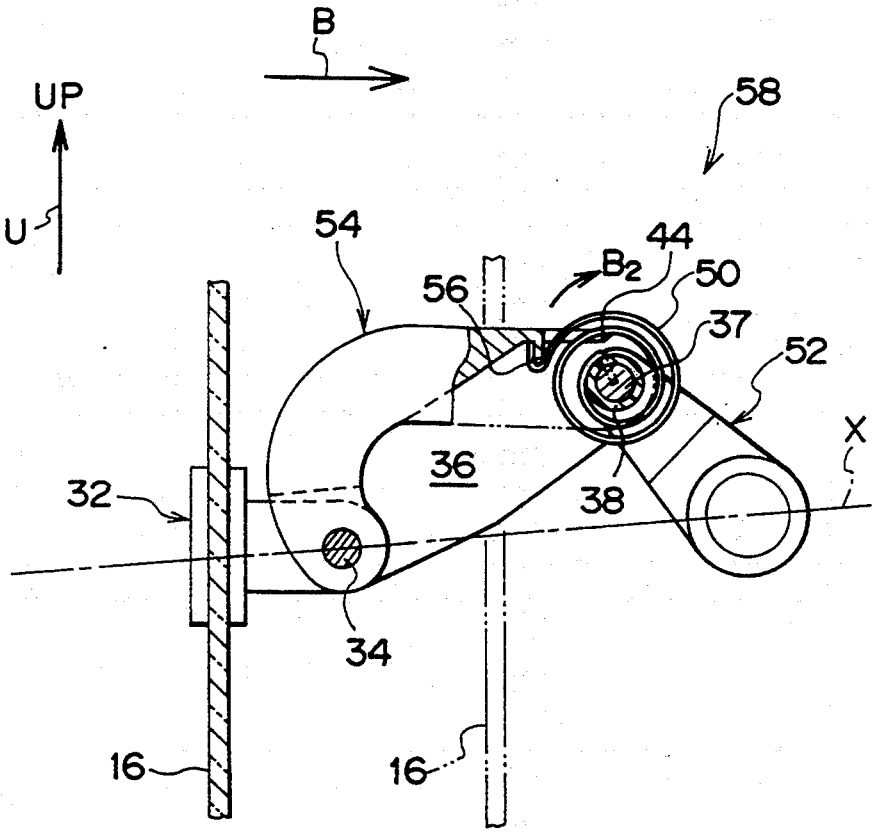
FIG. 6 is an operational diagram corresponding to FIG. 1 and illustrates essential portions of another embodiment in which a spiral spring is used instead of a torsion coil spring.
Figure 7:
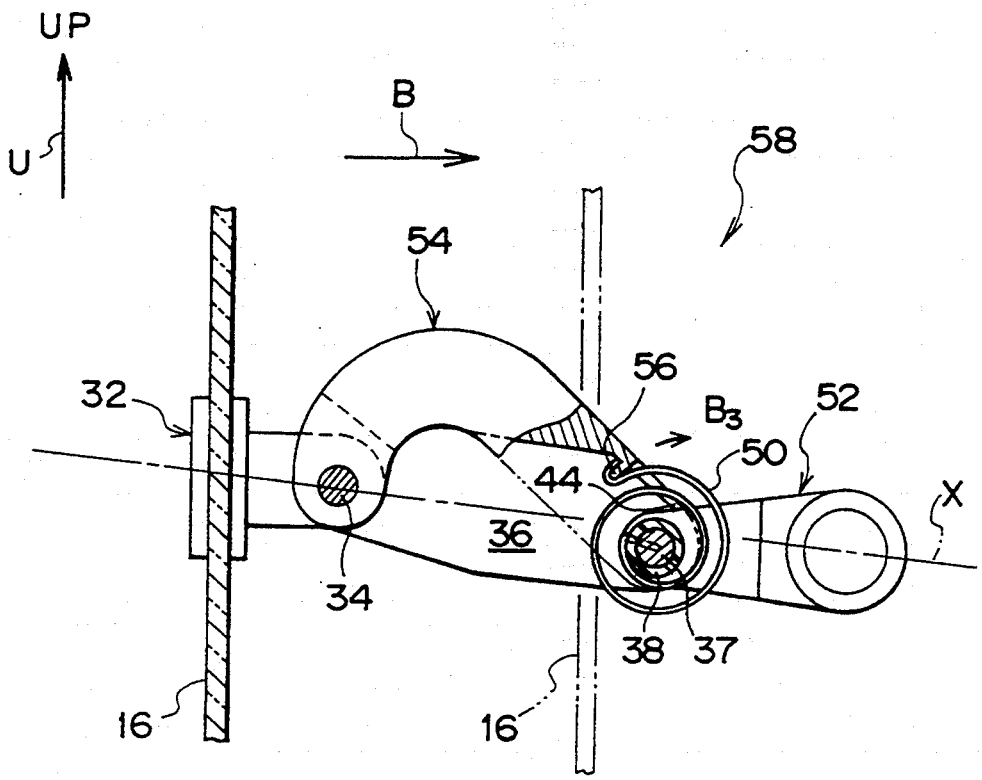
FIG. 7 is an operational diagram corresponding to FIG. 2.
Figure 8:
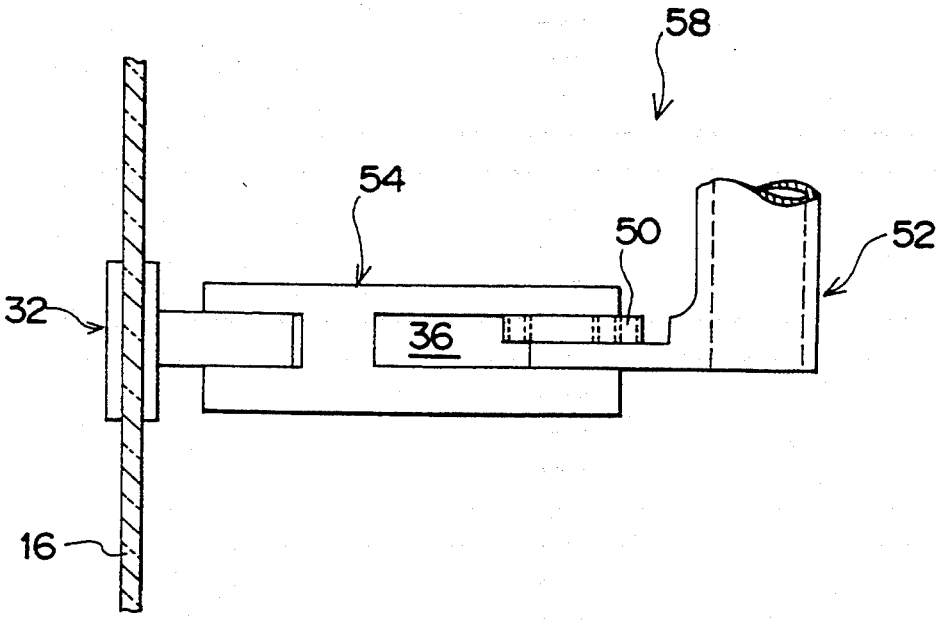
FIG. 8 is a bottom view of a link mechanism shown in FIG. 7.
Figure 9:
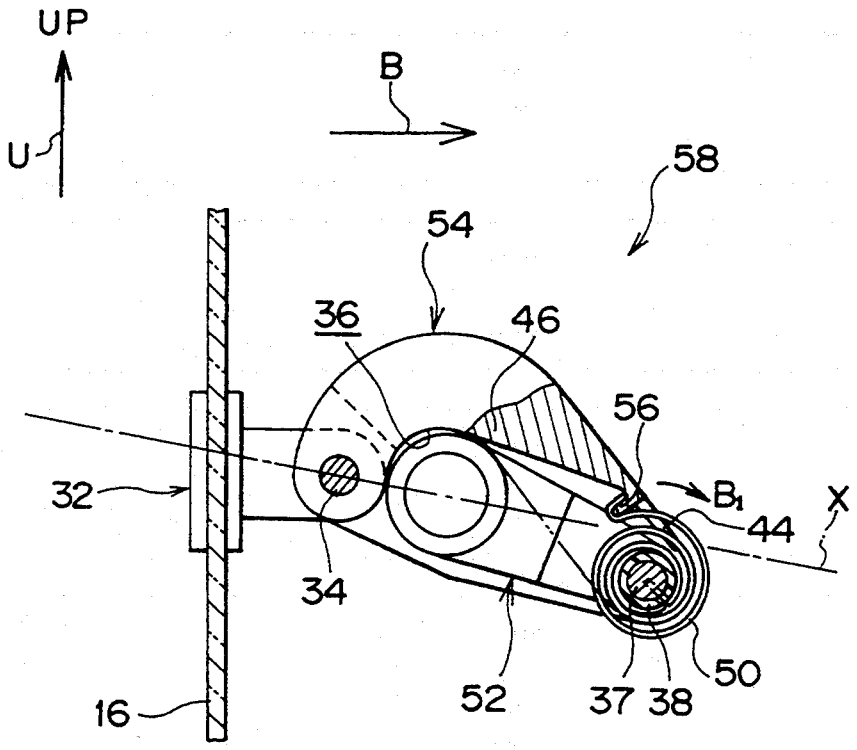
FIG. 9 is an operational diagram corresponding to FIG. 4.

Referring now to FIGS. 6 to 9, a description will be given of an example in which a spiral spring 50 is used instead of the torsion coil spring 40. FIG. 9 is a side elevational view of the state of the link mechanism 20 when the quarter window 16 is set in the fully closed state. FIGS. 7 and 8 are a side elevational view and a bottom view of the state of the link mechanism 20 when the quarter window 16 is set in the fully open state. Further, FIG. 6 is a side elevational view of the state of the link mechanism 20 when the quarter window 16 is set in the semi-open state. Incidentally, the same component parts as those of the example in which the torsion coil spring 40 is used are denoted by the same reference numerals, and a description thereof will be omitted.

As shown in FIGS. 6 to 9, the spiral spring 50 is disposed around an outer peripheral portion of the connecting pin 37 connecting a first link 52 and a second link 54 (more accurately, around the outer periphery of the collar 38). An inner end of the spiral spring 50 is inserted in and retained at an unillustrated slit formed in the connecting pin 37. It should be noted that although, in the embodiment using the torsion coil spring 40, the connecting pin 37 may undergo relative rotation with respect to the first link 52, the connecting pin 37 in this embodiment is formed integrally with the first link 52, and therefore rotates together with the first link 52. In addition, an outer end of the spiral spring 50 is retained by a projection 56 formed on the apex wall portion of the second link 54.

The spiral spring 50 itself has an urging force acting in the direction in which the diameter increases to cause the spiral spring 50 to return to its natural state. For this reason, the spiral spring 50 urges the second link 54 in the direction of a tangent to an outer end thereof. That is, the spiral spring 50 urges the second link 54 in the direction of $B_1$ in the fully closed state of the quarter window 16 shown in FIG. 9, urges the second link 54 in the direction of $B_2$ in the semi-open state of the quarter window 16 shown in FIG. 6, and urges the second link 54 in the direction of $B_3$ in the fully open state of the quarter window 16 shown in FIG. 7. Accordingly, when the entire system of a link mechanism 58 is considered, the spiral spring 50 urges the quarter window 16 in its closing direction (i.e., in the direction of arrow B in FIGS. 6, 7, and 9) by means of the second link 26 in all of the fully closed, semi-open, and fully open states.

In accordance with the embodiment using the above-described spiral spring 50, since the spiral spring 50 has the urging force acting in the closing direction of the quarter window 16, it is possible to prevent the rattling of the quarter window 16 even when the quarter window 16 is set in the semi-open state. In addition, in this embodiment using the spiral spring 50, since both the first and second links 52 and 54 can be made thin (see FIG. 8), the link mechanism 58 can be made compact.

It should be noted that, in the above-described embodiments, the quarter window opening/closing apparatus 10 is an electrically operating type which is provided with the driving unit 18. However, the present invention is not confined to the same. A manually operating arrangement may be adopted.

In addition, in the above-described embodiments, the torsion coil spring 40 or the spiral spring 50 is used as the urging means. However, the present invention is not confined to the same, and any type of urging means may be used insofar as it is capable of urging the quarter window in its opening or closing direction by means of the second link when the quarter window is set in a state other than the fully open or fully closed state. In other words, in the case where the torsion coil spring 40 is used, the urging direction differs depending on the degree of opening of the quarter window 16 (the urging direction being the closing direction in the fully open and fully closed states, and the opening direction in the semi-open state). On the other hand, in the case where the spiral spring 50 is used, the urging direction is the same (i.e., the closing direction) irrespective of the degree of opening of the quarter window 16. As such, if the urging means is seen from the standpoint of preventing the rattling of the quarter window 16, it can be said that the urging direction may be either the opening direction or the closing direction. For instance, in the embodiment using the spiral spring 50, if the position where its outer end is retained at the second link 54 is changed, it is possible to allow the urging force of the link mechanism 58 with respect to the entire system in the semi-open state to act in the opening direction of the quarter window 16. Even if the urging force is thus set to the opening direction, it is possible to obtain the effect of rattling prevention.

Figure 10:
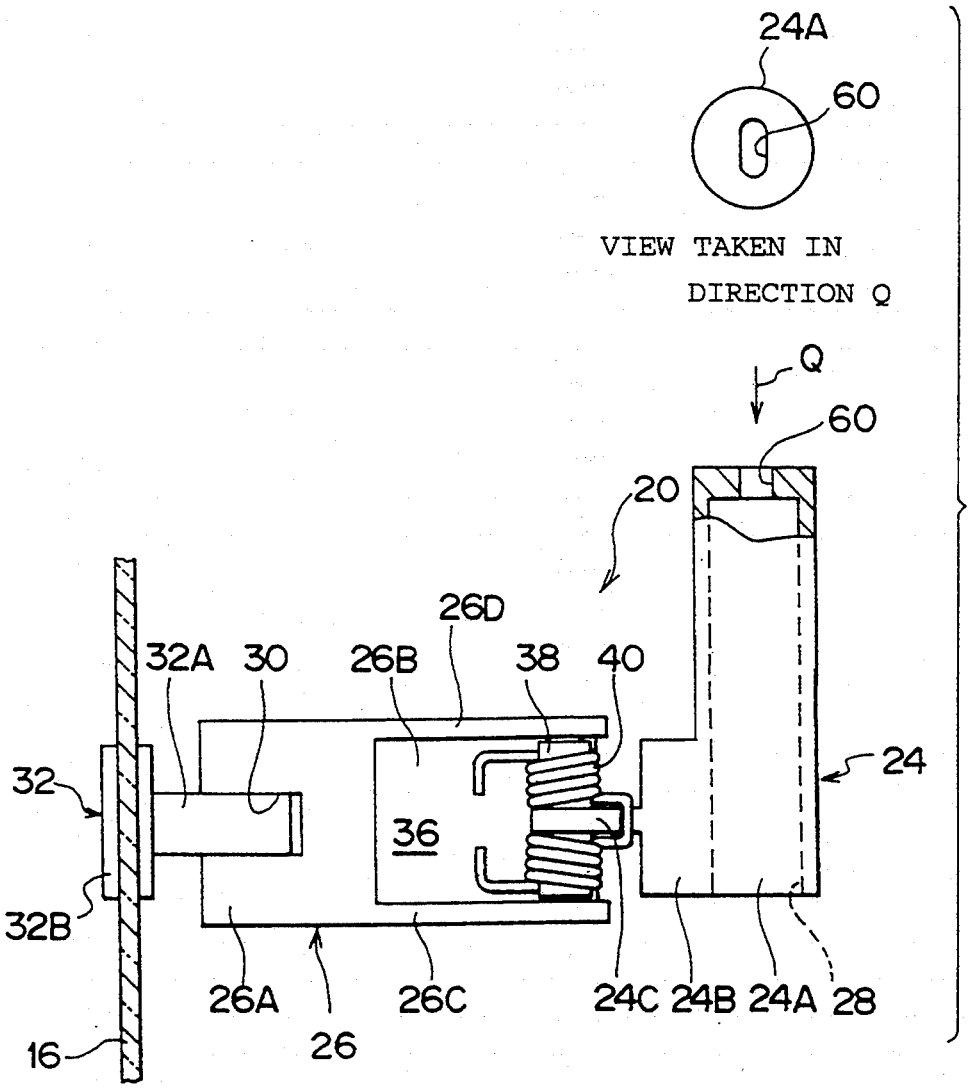
FIG. 10 is a bottom view illustrating a modification of a first link to which a motor is directly coupled.
Figure 11:
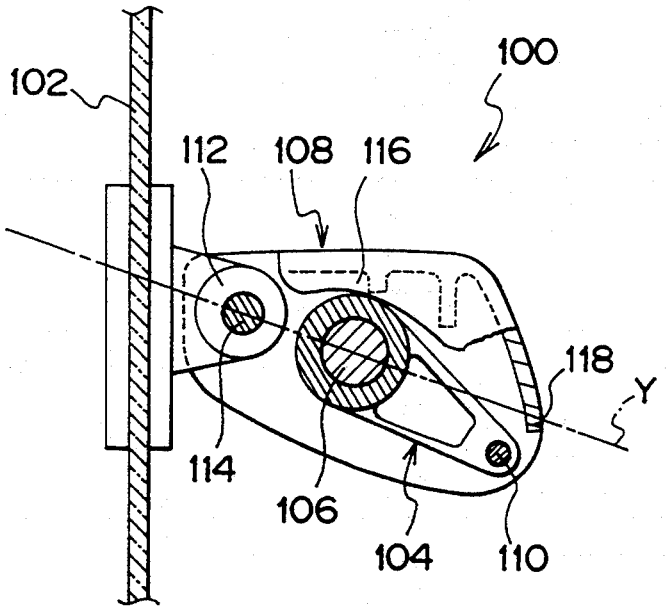
FIG. 11 PRIOR ART
FIG. 11 is an operational diagram similar to FIG. 4 and illustrates a conventional example.
Figure 12:
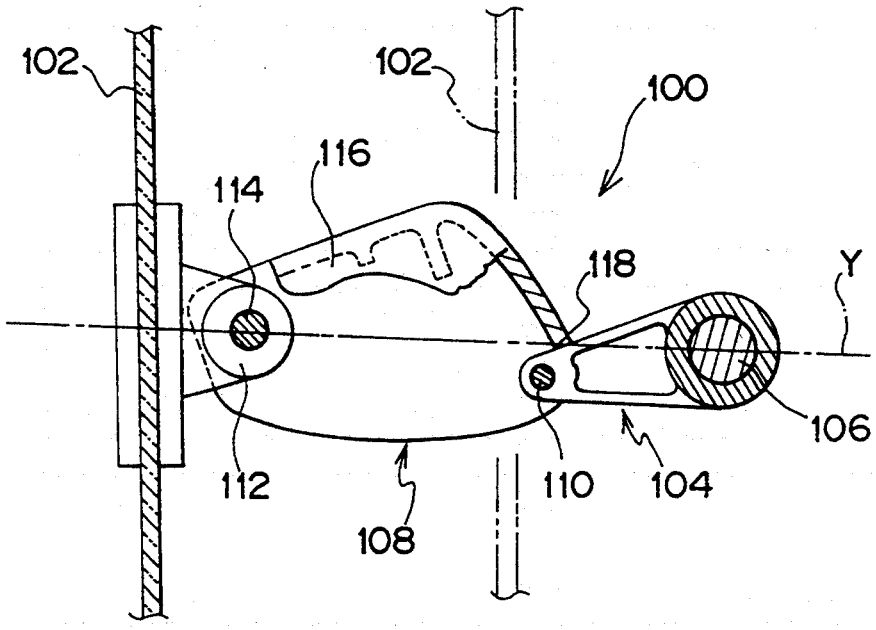
FIG. 12 PRIOR ART
FIG. 12 is an operational diagram similar to FIG. 2 and illustrates the conventional example shown in FIG. 11.
Figure 13:
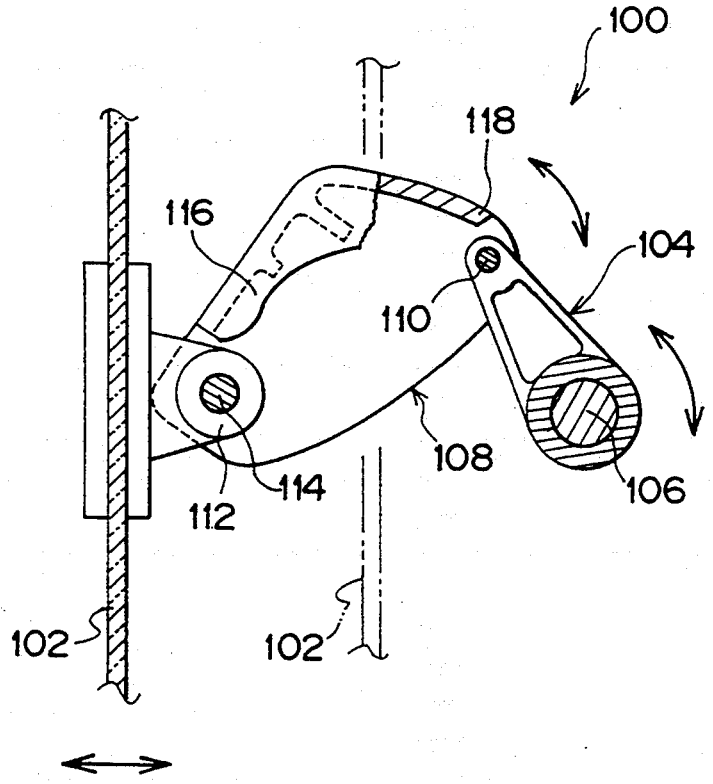
FIG. 13 PRIOR ART
FIG. 13 is an operational diagram similar to FIG. 1 and illustrates the conventional example shown in FIG. 11.

Furthermore, although, in the above-described embodiments, the arrangement adopted is such that the spline shaft 29 is fitted into the through hole 28 provided in the boss 24A of the first link 24, and the spline shaft 29 and the output shaft of the motor are connected by means of the connecting means, the present invention is not confined to the same. For instance, an arrangement may be provided such that the output shaft of the motor is directly coupled to the first link 24, as shown in FIG. 10. Namely, one end of the boss 24A of the first link 24 is made to be a closed end, and a substantially elliptical engaging hole 60 is formed in a central portion of the closed end, the output shaft of the motor being fitted in this engaging hole 60. Similarly, this arrangement may be applied to the example using the spiral spring 50 shown in FIGS. 6 to 9.

What is claimed is:

1. A quarter window opening/closing apparatus comprising:

a quarter window;

a first link having a proximal attached rotatably to a vehicle body;

a second link having a proximal end connected rotatably to a distal end of said first link and said second link having a distal end attached rotatably to said quarter window; and urging means provided at a link-connecting portion where said proximal end of said second link is connected rotatably to said distal end of said first link, said urging means being adapted to urge said quarter window in one of an opening direction or a closing direction by means of said second link when said quarter window is in a state other than a fully closed state or a fully open state, said urging means maintaining both said fully closed state and said fully open state by generating a urging force applied at said first link and said second link;

said second link further comprising a stopper for preventing rotation of said first and second links when said quarter window is in said fully closed state or said fully open state, and said link-connecting portion is located on a lower side, as viewed in a vertical direction of said vehicle body, with respect to a straight line connecting a center of rotation of a first link-attaching portion where said proximal end of said first link is attached to said vehicle body and a center of rotation of a second link-attaching portion where said other end of said second link is attached to said quarter window.

2. A quarter window opening/closing apparatus according to claim 1 wherein said second link has a supporting member at said link-connecting portion, and said supporting member supports said first link onto said second link.

3. A quarter window opening/closing apparatus according to claim 2, wherein said supporting member has a shaft member supported by said second link and a collar fitted over an outer peripheral portion of said shaft member, said first link being fixed to an outer peripheral portion of said collar.

4. A quarter window opening/closing apparatus according to claim 3 wherein said urging means is a torsion coil spring having at least one portion wound around said collar.

5. A quarter window opening/closing apparatus according to claim 4 wherein said torsion coil spring has a substantially intermediate portion engaged by said distal end of said first link, and said torsion coil spring having proximal and distal ends abutting against said second link.

6. A quarter window opening/closing apparatus according to claim 3 wherein said shaft member is fixed to one of said first or second links.

7. A quarter window opening/closing apparatus according to claim 6 wherein said urging means is a spiral spring whose inner end is retained by said shaft member and whose outer end is retained by one of said first or second links.

8. A quarter window opening/closing apparatus according to claim 1, further comprising driving means provided on a first link-attaching portion where said proximal end of said first link is attached to said vehicle body, so as to impart a rotational force to said first link.

9. A quarter window opening/closing apparatus according to claim 8 wherein said first link-attaching portion of said first link is provided with a cylindrical hole having a closing portion for closing an axial end thereof, and said closing portion is provided with a substantially elliptical engaging hole for fitting to an output shaft provided on said driving means.

10. A quarter window opening/closing apparatus according to claim 1 wherein said quarter window has a quarter window holding member which is pivotally supported by a second link-attaching portion where said distal end of said second link is attached to said quarter window.

11. A quarter window opening/closing apparatus comprising:

a quarter window;

a first link having a proximal end attached rotatably to a vehicle body: a second link having a shaft member supported by a proximal end of said second link and a collar fitted over an outer peripheral portion of said shaft member, a distal end of said first link being rotatably connected to a peripheral portion of said collar, and a distal end of said second link being attached rotatably to said quarter window; and a torsion coil spring provided on a link-connecting portion where said distal end of said first link is connected rotatably to said peripheral portion of said collar, said torsion coil spring having at least one portion wound around said collar, and said torsion coil spring being adapted to urge said quarter window in one of an opening direction or a closing direction by means of said second link when said quarter window is in a state other than a fully closed state or a fully open state, said torsion coil spring maintaining both said fully closed state and said fully open state by generating a urging force applied at said first link and said second link;

wherein said torsion coil spring has a substantially intermediate portion engaged by said distal end of said first link, and said torsion coil spring having proximal and distal ends abutting against said second link, and said quarter window has a quarter window holding member which is pivotally supported by a second link-attaching portion where said other distal end of said second link is attached to said quarter window; and said second link further comprising a stopper for preventing rotation of said first and second links when said quarter window is in said fully closed state or said fully open state, and said link-connecting portion is located on a lower side, as viewed in a vertical direction of said vehicle body, with respect to a straight line connecting a center of rotation of a first link-attaching portion where said proximal end of said first link is attached to said vehicle body and a center of rotation of a second link-attaching portion where said other end of said second link is attached to said quarter window.

12. A quarter window opening/closing apparatus according to claim 11, further comprising driving means provided on said first link-attaching portion where said proximal end of said first link is attached to said vehicle body, so as to impart a rotational force to said first link.

13. A quarter window opening/closing apparatus according to claim 12 wherein said first link-attaching portion of said first link is provided with a cylindrical hole having a closing portion for closing an axial end thereof, and said closing portion is provided with a substantially elliptical engaging hole for fitting to an output shaft provided on said driving means.

14. A quarter window opening/closing apparatus comprising:

a quarter window;

a first link having a proximal end attached rotatably to a vehicle body;

a second link having a shaft member supported by a proximal end of said second link and fixed to one of said first or second links and a collar fitted over a peripheral portion of said shaft member, a distal end of said first link being rotatably connected to said peripheral portion of said collar, and a distal end of said second link being attached rotatably to said quarter window; and a spiral spring provided on a link-connecting portion where said distal end of said first link is connected rotatably to said peripheral portion of said collar, said spiral spring having an inner end retained by said shaft member and an outer end retained by one of said first or second links, and said spiral spring being adapted to urge said quarter window in one of an opening direction or a closing direction by means of said second link when said quarter window is in a state other than a fully closed state or a fully open state, said spiral spring maintaining both said fully closed state and said fully open state by generating a urging force applied at said first link and said second link;

wherein said quarter window has a quarter window holding member which is pivotally supported by a second link-attaching portion where said distal end of said second link is attached to said quarter window; and said second link further comprising a stopper for preventing rotation of said first and seconds link when said quarter window is in said fully closed state or said fully open state, and said link-connecting portion is located on a lower side, as viewed in a vertical direction of said vehicle body, with respect to a straight line connecting a center of rotation of a first link-attaching portion where said proximal end of said first link is attached to said vehicle body and a center of rotation of a second link-attaching portion where said other end of said second link is attached to said quarter window.

15. A quarter window opening/closing apparatus according to claim 14, further comprising driving means provided on said first link-attaching portion where said proximal end of said first link is attached to said vehicle body, so as to impart a rotational force to said first link.

16. A quarter window opening/closing apparatus according to claim 15 wherein said first link-attaching portion of said first link is provided with a cylindrical hole having a closing portion for closing an axial end thereof, and said closing portion is provided with a substantially elliptical engaging hole for fitting to an output shaft provided on said driving means.

* * * * *